US005238179A

United States Patent [19]

Hart

[11] Patent Number: 5,238,179

[45] Date of Patent: Aug. 24, 1993

[54] TOP OPENING CARTON WITH INTEGRAL INTERNAL HANDLE

[75] Inventor: Joseph J. Hart, Philadelphia, Pa.

[73] Assignee: Jefferson Smurfit Corporation, Clayton, Mo.

[21] Appl. No.: 128

[22] Filed: Jan. 4, 1993

[51] Int. Cl.[5] ..... B65D 5/46; B65D 5/56

[52] U.S. Cl. ..... 229/117.13; 220/418; 229/117.22

[58] Field of Search ..... 229/117.12, 117.13, 229/117.22, 117.23, 117.24; 220/408, 410, 416, 418

[56] References Cited

U.S. PATENT DOCUMENTS

| | | | |
|---|---|---|---|
| 2,739,752 | 3/1956 | Pritchett | 229/117.13 |
| 2,981,455 | 4/1961 | Cope | 229/117.23 |
| 3,074,614 | 1/1963 | Moffat | 229/117.22 |
| 3,146,937 | 9/1964 | Vesak | 229/117.22 |
| 3,570,665 | 3/1971 | Houston et al. | 229/117.23 |
| 3,837,563 | 9/1974 | Brackette, Jr. | 229/117.13 |
| 4,986,420 | 1/1991 | Gunn et al. | 229/117.22 |
| 5,065,937 | 11/1991 | Ritter | 229/117.13 |

FOREIGN PATENT DOCUMENTS

| | | | |
|---|---|---|---|
| 1249255 | 1/1989 | Canada | 229/117.22 |
| 1427854 | 1/1966 | France | 229/117.13 |
| 2483885 | 12/1981 | France | 229/117.23 |
| 2246114 | 1/1992 | United Kingdom | 229/117.24 |

*Primary Examiner*—Gary E. Elkins
*Attorney, Agent, or Firm*—Richard W. Carpenter

[57] ABSTRACT

A carton having a reclosable cover and an integral internal handle that is adapted to be folded into the carton before the carton is initially opened, and which is adapted to be extended out of the carton after the cover has been initially opened and thereafter reclosed.

12 Claims, 2 Drawing Sheets

TOP OPENING CARTON WITH INTEGRAL INTERNAL HANDLE

BACKGROUND OF THE INVENTION

1. Field of the Invention

This invention relates to paperboard cartons of the type used in the packaging of heavy products, such as detergents, and more particularly to an improved handle arrangement wherein an integral handle is adapted to be folded inside of a carton before the carton cover is initially opened, and is also adapted to extend out of the carton after the cover has been reclosed.

2. A background art search directed to the subject matter of this invention and conducted in the United States Patent and Trademark Office disclosed the following U.S. Pat. Nos.:

2,006,454, 2,065,483, 2,496,619, 2,599,800, 2,719,665, 2,987,235, 3,019,960, 3,074,614, 3,093,294, 3,099,380, 3,140,812, 3,140,813, 3,146,937, 4,171,763.

None of the patents found in the search discloses a carton with a reclosable cover having an integral internal handle that can be folded inside of the carton before the carton has been opened for the first time, and that can thereafter be extended out of the carton after the carton has been reclosed.

SUMMARY OF THE INVENTION

It is a primary object of the present invention to provide an improved handle arrangement for a paperboard carton of the type used in the packaging of relatively heavy products, such as detergents and the like.

Another object of the invention is the provision of a carton handle arrangement whereby an internal handle can be extended outside of the carton, so it can be used to carry the carton after the carton cover has once been opened and reclosed.

A more specific object of the invention is to provide a carton handle arrangement for a carton having an outer body and an inner liner with an integral handle adapted to be folded inside the carton before the cover is first opened and also adapted to be extended out of the carton after the cover has been opened and thereafter reclosed.

These and other objects of the invention will be apparent from an examination of the following description and drawings.

It will be understood that, for purposes of clarity, certain elements of the invention may have been intentionally omitted from certain views where they are believed to be illustrated to better advantage in other views.

DESCRIPTION OF THE PREFERRED EMBODIMENT

Figure 1:
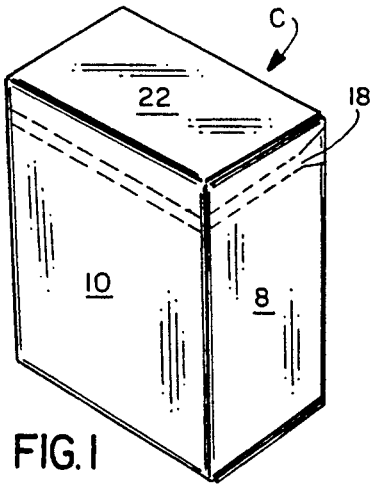
FIG. 1 is a fragmentary isometric view of a carton embodying features of the present invention, shown prior to the initial opening of the carton.
Figure 2:
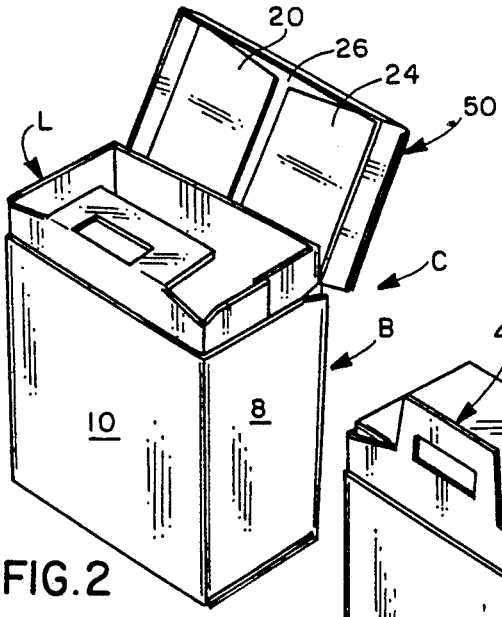
FIG. 2 is a view similar to that of FIG. 1, but with the carton shown after being opened and before being reclosed.
Figure 3:
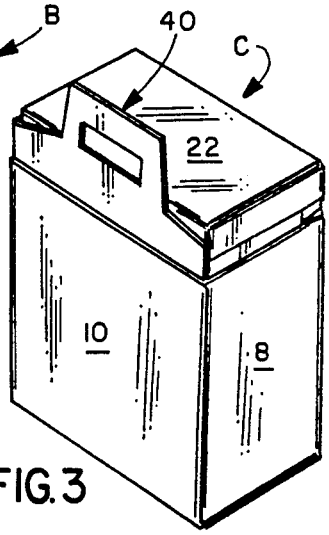
FIG. 3 is also a view similar to that of FIG. 1, but with the carton shown after it has been opened and reclosed.
Figure 4:
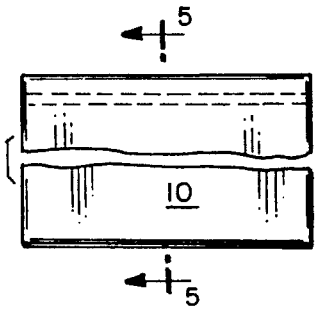
FIG. 4 is a fragmentary side elevational view of the structure illustrated in FIG. 1, with portions of the structure broken away.
Figure 5:
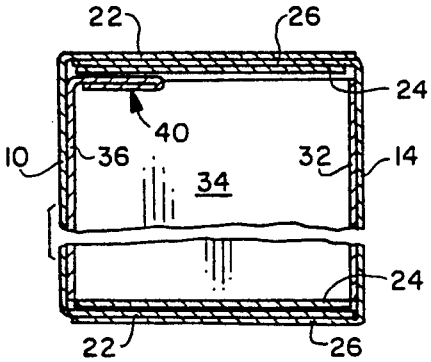
FIG. 5 is a vertical sectional view taken on line 5—5 of FIG. 4.
Figure 6:
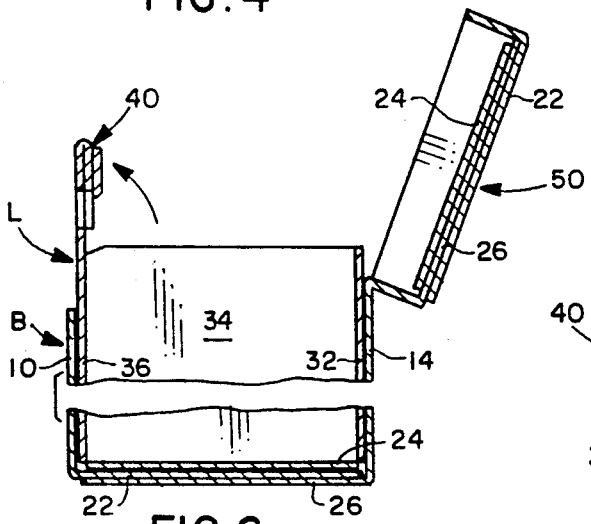
FIGS. 6 and 7 are views similar to that of FIG. 5, but with the carton cover and handle shown in the positions illustrated in FIGS. 2 and 3, respectively.

Referring now to the drawings for a better understanding of the invention, and particularly to FIGS. 1-3, it will be seen that the carton of the present invention, indicated generally at C, comprises an outer body member or shell B and an inner liner member or insert L.

Figure 8:
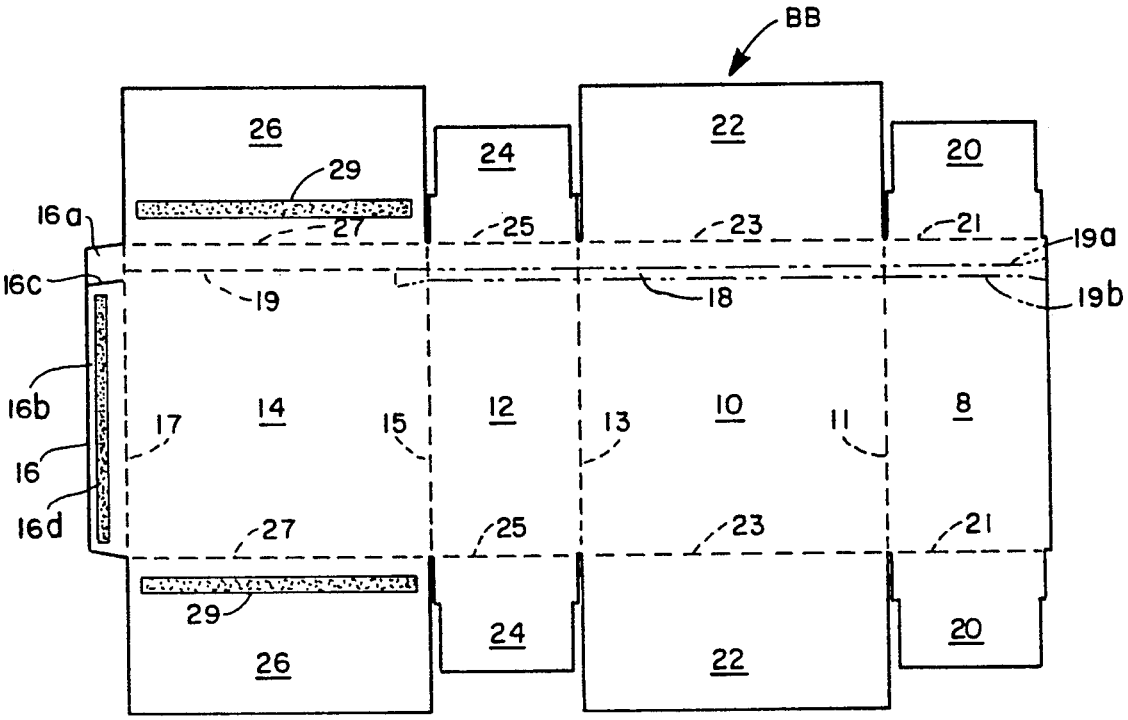
FIGS. 8 and 9 are plan views of the blanks of foldable sheet material from which the carton and liner, respectively, of the previous views may be formed.
Figure 9:
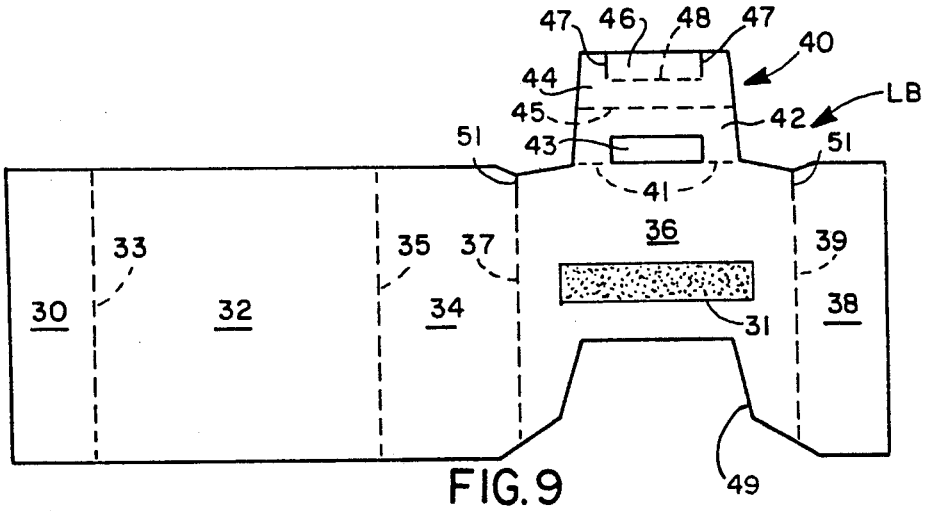

The body member B and the liner member L may be formed from unitary blanks BB and LB of foldable sheet material, such as paperboard, illustrated in FIGS. 8 and 9, respectively.

As best seen in FIG. 8, body member B comprises a first minor side wall panel 8, a first major side wall panel 10, a second minor side wall panel 12, a second major side wall panel 14, and a glue panel 16 that are foldably joined to each other along parallel fold lines 11, 13, 15, and 17, respectively.

Glue panel 16 is divided into separate upper and lower sections **16*a* and 16*b*, respectively by a cut line 16*c* that extends inwardly from the free outer edge of the glue panel to the fold line 17. Glue panel lower section may be coated with adhesive, as indicated at 16*d***.

Still referring to FIG. 8, it will be seen that the side wall panels are provided with a pair of vertically spaced, horizontally extending, parallel lines of weakness **19*a* and 19*b* that define a detachable tear strip 18**, therebetween. If desired the tear strip may be reinforced by a strip of other material (not shown).

When the tear strip is removed a cover 50, hereinafter described, is formed, and the cover is hinged to side wall panel 14 along a hinge line **19*c***.

At its upper and lower ends the carton body member B includes first minor closure flaps 20, first major closure flaps 22, second minor closure flaps 24, and second major closure flaps 26, which are foldably joined to upper and lower ends of side wall panels 8, 10, 12, and 14 along fold lines 21, 23, 25, and 27, respectively.

Closure flaps 26 may be provided with strips of adhesive 29 to secure them to the related closure flaps to close the ends of the carton.

In addition to the shell or outer body member B the carton C includes an insert or inner liner member L, which may be formed from the blank LB of foldable paperboard illustrated in FIG. 9.

Liner member L includes a first minor side panel first section 30, a first major side panel 32, a second minor side panel 34, a second major side panel 36, and a first minor side panel second section 38 that are foldably joined to each other along parallel fold lines 33, 35, 37, and 39, respectively.

Panel 36 may be provided with a strip of adhesive 31 for attachment of the liner member to the body member.

An essential feature of the invention resides in the provision of a handle, indicated generally at 40, which is an integral part of the liner member.

Handle 40 includes a first section 42, foldably joined to the upper edge of panel 36 on a fold line 41, and a second section 44, foldably joined to first section 42 on fold line 45.

First section 42 has a central hand hole opening 43 adapted for alignment with a corresponding opening in the section section. The second section has a reinforcing tab 46, formed by parallel cut lines 47 and hinge line 48. When first and second sections are folded in face-to-face relation, tab 46 is folded 180 degrees through opening 43.

As best seen in FIG. 9, liner member panel 36 is provided at its lower end with a cut out or recess 49, which accomodates the nesting of the blank LB with a related blank with the handle portion of one blank being formed from material taken from an adjacent portion of an adjacent blank.

It is important that the upper portions of liner member second major side panel 36 is separated from upper portions of adjacent minor side panels by slits or slots 51, which are in line with fold lines 37 and 39.

In order to form the carton C, the liner member blank LB is placed over the body member blank BB and panel 36 of the liner member, which carries the handle, is secured to adjacent side wall panel 10 of the body member by the adhesive at 39.

The liner and body member blanks are then folded about the fold lines separating the panels from each other, and the glue panel 16 is secured to minor side wall panel 8 by the adhesive indicated at **16*d***.

Before the carton is filled with product, the lower end of the carton is closed by folding the lower closure flaps inwardly and securing them together in overlapped relation by adhesive as indicated at 29.

The carton can then be filled with product and the handle 40 folded inwardly 90 degrees from the liner member side panel 36 to which it is attached.

The upper end of the carton can then be closed by folding the upper closure flaps inwardly 90 degrees and securing them together in overlapped relation by adhesive, as indicated at 29.

In order to open the carton initially, tear strip 18 is detached from the carton to separate three body side wall panels into upper and lower portions. The upper portions, together with the upper closure flaps to which they are attached, form a reclosable cover 50, which is hingedly attached on hinge line **19*c* to an upper portion of body member side wall panel 14**.

It should be noted that before the cover is initially opened it covers upper portions of the other three liner member panels. After the cover is opened, handle 50 may be pulled or folded upwardly to project out of the carton.

Figure 7:
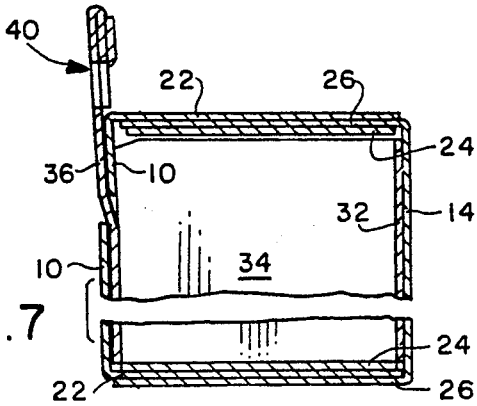

The cover can then be closed, as shown in FIGS. 3 and 7, because the slits or slots 51 allow the cover to come all the way down to its original position where it covers only two of the liner member side panels, while the handle 50 and a portion of its related panel 36 project upwardly out of the carton.

Thus, it will be appreciated that the invention provides a unique handle arrangement for a paperboard carton whereby an integral internal handle is secured to a liner member in such a way that it can be folded to lie inside of the carton until the carton cover is initially opened, and thereafter can be folded to extend out of the carton when the cover is reclosed.

What is claimed is:

1. A top opening reclosable carton with an integral internal handle adapted for use after the carton has been initially opened, said carton comprising:

(a) an outer body member and an inner liner member, each of which is formed from a unitary blank of foldable paperboard;

(b) said body member including:

(i) pairs of opposed side walls foldably joined to each other forming a tubular structure having open upper and lower ends:

(ii) pairs of opposed upper and lower closure flaps foldably joined to upper and lower ends of said side walls and secured to each other in overlapped relation to close said tubular structure upper and lower ends, respectively;

(iii) three of said body member side walls having, adjacent their upper ends, weakened lines of tear defining a detachable tear strip which, together with a hinge line in a fourth of said side walls, forms, from said upper closure flaps and portions of said side walls, a reclosable cover;

(c) said liner member including pairs of opposed side panels arranged and disposed in face-to-face relationship with inner surfaces of adjacent of said body member side walls to reinforce said side walls;

(d) certain of said liner member side panels being adhesively secured to certain of said body member side walls;

(e) said handle being hinged along a fold line to an upper edge of one of said liner member side panels and being adapted to be folded inside of the carton before said cover has been initially opened and being adapted to be extended out of said carton after said cover has been opened and reclosed.

2. A carton according to claim 1, wherein, said one liner member side panel to which said handle is hinged is located opposite said body member fourth side wall to which said cover is hinged.

3. A carton according to claim 1, wherein before said cover is initially opened it extends over upper portions of three of said liner member side panels, and after said cover has been initially opened and thereafter reclosed said cover extends over only two of said liner member side panels.

4. A carton according to claim 1, wherein said one liner member side panel to which said handle is hinged has upper portions separated from upper portions of adjacent liner member side wall panels to permit the insertion of a portion of said cover therebetween.

5. A top opening reclosable carton with an integral internal handle adapted for use after the carton has been initially opened, said carton comprising:

(a) an outer body member and an inner liner member, each of which is formed from a unitary blank of foldable paperboard;

(b) said body member including:

(i) pairs of opposed side walls foldably joined to each other forming a tubular structure having open upper and lower ends:

(ii) pairs of opposed upper and lower closure flaps foldably joined to upper and lower ends of said side walls and secured to each other in overlapped relation to close said tubular structure upper and lower ends, respectively;

(iii) said body member having, adjacent its upper end, a detachable a reclosable cover hinged to one of said body member side walls;

(c) said liner member including a plurality of side panels arranged and disposed in face-to-face relationship with inner surfaces of adjacent of said body member side walls to reinforce said side walls;

(d) certain of said liner member side panels being adhesively secured to certain of said body member side walls;

(e) said handle being hinged along a fold line to an upper edge of one of said liner member side panels and being adapted to be folded inside of the carton before said cover has been initially opened and being adapted to be extended out of said carton after said cover has been opened and reclosed.

6. A carton according to claim 5, wherein, said one liner member side panel to which said handle is hinged is located opposite said body member one side wall to which said cover is hinged.

7. A carton according to claim 5, wherein before said cover is initially opened it extends over upper portions of three of said liner member side panels, and after said cover has been initially opened and thereafter reclosed said cover extends over only two of said liner member side walls.

8. A carton according to claim 5, wherein said one liner member side panel to which said handle is hinged has upper portions separated from upper portions of adjacent liner member side wall panels to permit the insertion of a portion of said cover therebetween.

9. A top opening reclosable carton with an integral internal handle adapted for use after the carton has been initially opened, said carton comprising:

(a) an outer body member and an inner liner member, each of which is formed from a unitary blank of foldable paperboard;

(b) said body member including:

(i) pairs of opposed side walls foldably joined to each other forming a tubular structure having open upper and lower ends:

(ii) pairs of opposed upper and lower closure flaps foldably joined to upper and lower ends of said side walls and secured to each other in overlapped relation to close said tubular structure upper and lower ends, respectively;

(iii) said body member having, adjacent its upper end, a detachable cover;

(c) said liner member including at least one side panel arranged and disposed in face-to-face relationship with an inner surface of an adjacent one of said body member side walls to reinforce said adjacent one side wall;

(d) certain of said liner member side panels being adhesively secured to certain of said body member side walls;

(e) said handle being hinged along a fold line to an upper edge of one of said liner member side panels and being adapted to be folded inside of the carton before said cover has been initially opened and being adapted to be extended out of said carton after said cover has been opened and reclosed.

10. A carton according to claim 9, wherein said cover is detachably connected to three of said body member side walls and hinged along a fold line to a fourth of said body member side walls.

11. A carton according to claim 10, wherein, said one liner member side panel to which said handle is hinged is located opposite said body member fourth side wall to which said cover is hinged.

12. A carton according to claim 9, wherein said cover is hingedly attached to one of said body member side walls.

* * * * *